US007967113B2

(12) United States Patent
Smith et al.

(10) Patent No.: US 7,967,113 B2
(45) Date of Patent: Jun. 28, 2011

(54) ELEVATOR SYSTEM TO MINIMIZE ENTRAPMENT OF PASSENGERS DURING A POWER FAILURE

(75) Inventors: Rory S. Smith, El Cajon, CA (US); Richard D. Peters, Bucks (GB); Lutfi Al-Sharif, England (GB)

(73) Assignee: Thyssenkrupp Elevator Capital Corporation, Troy, MI (US)

( * ) Notice: Subject to any disclaimer, the term of this patent is extended or adjusted under 35 U.S.C. 154(b) by 0 days.

(21) Appl. No.: 12/431,360

(22) Filed: Apr. 28, 2009

(65) Prior Publication Data

US 2010/0000825 A1 Jan. 7, 2010

Related U.S. Application Data

(63) Continuation of application No. 11/252,653, filed on Oct. 18, 2005, now Pat. No. 7,540,356.

(51) Int. Cl.
*B66B 1/34* (2006.01)

(52) U.S. Cl. ..... 187/393; 187/289

(58) Field of Classification Search ..... 187/247, 187/289, 290, 293, 288, 296, 297, 391–393; 318/798–815, 375, 376

See application file for complete search history.

(56) References Cited

U.S. PATENT DOCUMENTS

| | | | | |
|---|---|---|---|---|
| 5,893,432 | A * | 4/1999 | Nguyen et al. | 187/290 |
| 5,896,948 | A * | 4/1999 | Suur-Askola et al. | 187/290 |
| 5,986,948 | A | 11/1999 | Cloud | |
| 6,264,005 | B1 | 7/2001 | Kang et al. | |
| 6,315,081 | B1 | 11/2001 | Yeo | |
| 6,435,312 | B2 | 8/2002 | Tajima et al. | |
| 6,439,347 | B2 * | 8/2002 | Suga et al. | 187/290 |
| 6,827,182 | B2 | 12/2004 | Araki | |
| 7,374,020 | B2 * | 5/2008 | Smith et al. | 187/289 |
| 7,540,355 | B2 * | 6/2009 | Harkonen | 187/290 |
| 7,681,694 | B2 * | 3/2010 | Aulanko et al. | 187/290 |
| 2006/0231348 | A1 | 10/2006 | Komatsu | |
| 2007/0084673 | A1 * | 4/2007 | Smith et al. | 187/290 |

* cited by examiner

*Primary Examiner* — Jonathan Salata
(74) *Attorney, Agent, or Firm* — Frost Brown Todd LLC

(57) ABSTRACT

The invention provides a system and method for handling power outages in a multiple car elevator system in a building having a plurality of floors. The system includes an energy calculator connected to the elevators, and determines a total energy of the elevator system, a total energy required to handle a power outage, a plan to prepare for a power outage and a plan to handle a power outage. The system also includes a movement controller connected to the elevator(s) and the energy calculator. The movement controller receives the plan to prepare and the plan to handle from the energy calculator, and the movement controller executes the plan to prepare if there is no power outage and the movement controller executes the plan to handle if there is a power outage.

20 Claims, 9 Drawing Sheets

ELEVATOR SYSTEM TO MINIMIZE ENTRAPMENT OF PASSENGERS DURING A POWER FAILURE

CROSS REFERENCE TO RELATED APPLICATIONS

This application claims benefit to U.S. Non-Provisional application Ser. No. 11/252,653, filed Oct. 18, 2005, now U.S. Pat. No. 7,540,356 which is hereby incorporated by reference in its entirety.

BACKGROUND OF THE INVENTION

The problem of passengers becoming trapped in an elevator in the event of a power failure has long been a concern. In the event of a power failure, unless the building is equipped with functional emergency generators, passengers will be trapped until power is restored, perhaps hours later. Being trapped in a crowded elevator can be uncomfortable, frightening, and potentially dangerous.

Buildings above 75 feet in height are required to have emergency generators with sufficient capacity to operate at least one elevator during a power failure. Elevator control systems typically have what is known as "Emergency Power Operation." Even in buildings having functional emergency generators, the emergency power usually does not come on instantaneously. The power is typically interrupted for about 10 seconds. When the power is interrupted, the brakes are applied and the elevators abruptly stop, which can also be frightening and dangerous to riders. During a normal stop, the variable speed drive is used to ramp the speed of the elevator down until it is fully stopped, and then the brakes are applied as parking brakes. Emergency power does eventually allow the stopped elevators (one at a time) to evacuate their passengers down to the lobby before shutting down.

Power outages have two detrimental effects:

(1) When the power is lost, the elevators are subjected to voltage transients and mechanical operations that can cause the elevators to fault either electrically or mechanically. When emergency power is activated, those elevators that have faulted cannot be returned to service without intervention by trained elevator service personnel, leading to lengthy entrapment of passengers.

(2) The abrupt stoppage subjects passengers to negative accelerations that are not expected to exceed 1 g. However, a 1 g negative acceleration can cause people to fall and be injured. This is particularly true of elderly, handicapped, and infirm passengers.

It is desirable to eliminate or minimize the effects of power outages, or interruptions where emergency power is available, by allowing the elevator to continue running following a power outage until the next possible stop and stop normally rather than abruptly halting. This will minimize the chance of passenger injury or entrapment, reduce the possibility of a fault to the elevator electrical or mechanical systems, and leave the elevators in a condition that they can readily be placed back into service when the emergency generator comes on line or when power is restored.

BRIEF SUMMARY OF THE INVENTION

The present invention provides a system and method for handling power outages in an elevator system in a building having a plurality of floors. In the system, which includes one or more elevators, an energy calculator is connected to the elevators, and determines a total energy of the elevator system, a total energy required to handle a power outage, a plan to prepare for a power outage and a plan to handle a power outage. The system also includes a movement controller connected to the elevator(s) and the energy calculator. The movement controller receives the plan to prepare and the plan to handle from the energy calculator. The movement controller executes the plan to prepare if there is no power outage, and the movement controller executes the plan to handle if there is a power outage. The invention eliminates or minimizes sudden stoppage of elevators following a power failure by using the energy stored in the whole elevator system to power the elevators to a normal stop at the next possible floor or between floors if there is insufficient available energy.

DETAILED DESCRIPTION OF THE INVENTION

This invention is directed to eliminating or minimizing sudden stoppage of elevators following a power failure and allowing the elevators to carry out a normal stop at the next possible floor. In cases where there is insufficient energy in the system, elevators would be brought to a normal stop before arriving at the next floor. The present invention makes this possible by utilizing the energy that is naturally stored in some elevators and sharing that energy between all the moving elevators at the time of the power failure.

Each elevator in an elevator system has potential energy by virtue of its load (the mass of people in the elevator car) net of its counterweight, and its position in the building. When an elevator full of people (having a load greater than its counterweight) is transported to an upper floor, energy from the electrical power supply is converted into potential energy. Similarly, when an empty elevator car (having a load less than its counterweight) is transported to a lower floor, the potential energy of the elevator system increases.

Elevators both consume and regenerate power. A weight imbalance between a load in the elevator car and an elevator counterweight creates a net load torque on an elevator sheave in the direction of the heavier of the load and the counterweight. An elevator regenerates power when the elevator car moves in the same direction as the net load torque, such as when the elevator car (and contents) are heavier than the counterweight and moving down, or lighter than the counterweight and moving up. An elevator consumes energy when the elevator car moves in a direction opposite the net load torque.

The invention uses the potential energy and/or regenerated power of all of the elevators in an elevator system to ensure that there is sufficient energy to power all the moving elevators to a normal stop immediately following power supply interruption. In the event of a power outage, ideally all occupied elevators in the system are stopped at a floor. If there is insufficient energy in the system, the elevators might be allowed to stop normally between floors.

Figure 1:
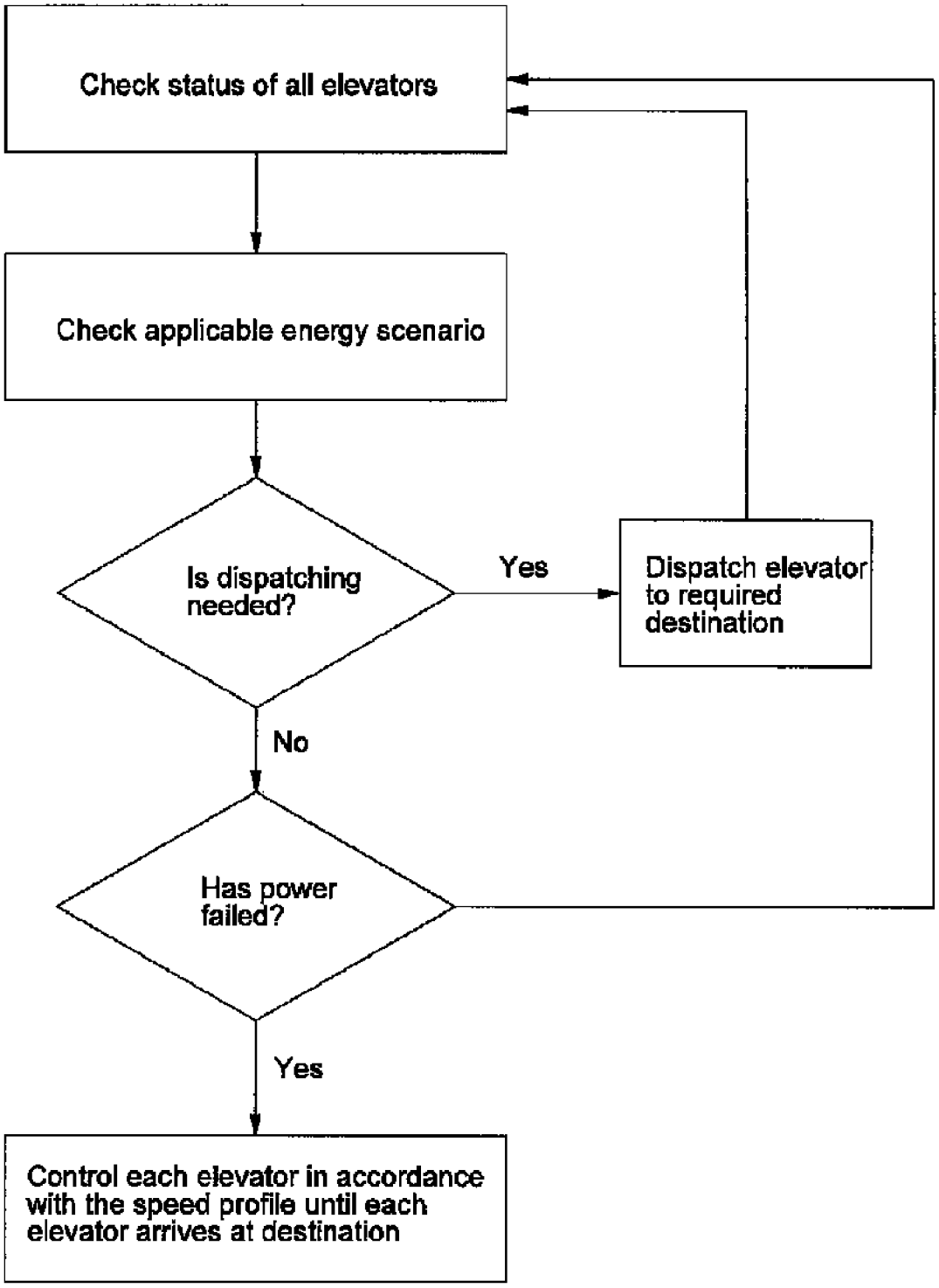
FIG. 1 is a flowchart showing the actions of an energy calculator according to the claimed invention before and after a power failure.

The invention comprises an energy calculator and a movement controller. The energy calculator continuously calculates the potential energy of each elevator and thus the total potential energy of the elevator system. Based on the total potential energy, the energy calculator classifies the energy status of the system into one of five scenarios that dictate a "plan to prepare" for a power interruption and a "plan to handle" a power failure if it occurs at that moment. Possible plans to prepare for a power interruption include recovering some of the potential energy if there is a deficiency by changing the speed or location of empty elevators or the speed of occupied elevators, and storing excess energy in DC capacitors or empty elevators if there is an energy surplus. The plan to handle a power failure is a schedule of speeds, directions and destinations for each elevator in the system to proceed to a normal stop, preferably at a floor. The plan to prepare for and plan to handle a power failure are continuously being determined by the energy calculator and communicated to a movement controller. The movement controller controls the execution of the plan to prepare for a power failure, or plan to handle a power failure if and when it occurs. A flowchart showing the actions of an energy calculator before and after a power failure is shown in FIG. 1.

If a power supply failure takes place, the movement controller takes control of the motion of all the elevators in accordance with the plan to handle a power failure received from the energy calculator. The movement controller controls the elevator drive system which in turn controls the direction, speed and stopping of each elevator. The elevator drive system, at the command of the movement controller, runs each elevator at a speed prescribed by the plan for handling the power failure. When an elevator approaches the stop prescribed by the energy calculator, the movement controller will send a command to the elevator drive system and the drive system will stop the elevator at the prescribed stop.

The energy calculator determines the plan to handle a power outage by classifying the system into one of five scenarios for handling a power outage. One handling rule is that all elevators in the elevator system that are regenerating power are sent to the furthest stop in their direction of travel, whereas all elevators that are consuming power are stopped at the nearest possible stop in their direction of travel. Another handling rule is that empty elevators that are consuming energy are stopped abruptly, to conserve energy needed to move occupied elevators.

In one embodiment, the variable speed drive (VSD) of each elevator is used to determine which elevators are regenerating power. In an alternative embodiment, the direction of the net load torque of each elevator is calculated and compared to its direction of travel; if they are the same, the elevator is regenerating power. In this embodiment, a load weighing device is used to determine the elevator car load in order to calculate the load torque. In both embodiments, regenerated power is supplied to other elevators in the elevator system by way of a common DC bus or stored by DC capacitors connected to the common DC bus.

In the event of a power outage, elevators that are consuming energy are directed to the next possible stop in their direction of travel to conserve energy. Elevators that are consuming energy are powered by regenerated power supplied by other elevators in the system, energy stored in the DC capacitors of the common bus or VSD, and/or the kinetic energy within the elevators.

Elevators that are stopped at floors will open their doors and permit passengers to exit. The elevator doors are opened using the energy stored in the DC capacitors of the VSD or common DC bus, or using batteries.

This invention can be used in buildings that do not have emergency generators. The control system of the invention requires its own backup power source in order to continue to operate in the event of a power outage. The control system power source could be an inverter backed up by batteries.

System Components

Virtually all new elevators utilize AC motors and variable speed drives (VSD's). The invention is based upon sharing energy among elevators in an elevator system by connecting the direct current (DC) buses of the VSD of each elevator to a common DC bus. Each VSD comprises capacitors that in addition to filtering ripple currents provide some short term energy storage. Additional DC capacitors are connected to the common DC bus to provide additional energy storage. In this regard, Applicants refer to U.S. patent application Ser. No. 10/788,854, filed Feb. 27, 2004, which is incorporated herein by reference.

An energy calculator monitors the energy status of the elevator system and determines a plan to prepare and a plan to handle a power outage. A movement controller executes the plant to prepare and plan to handle, if appropriate, by controlling the elevator drive system. The movement controller is powered by an inverter and is backed up by batteries (USP: uninterruptible power supply).

Each elevator in the elevator system is equipped with a load weighing device to measure the load status of each elevator. This information is input into the energy calculator.

Energy Calculator

The energy calculator has information about the static and dynamic data of the elevator system. These include static parameters such as: (i) a map of the position of each floor in a building in millimeters; (ii) the counterweight ratio of each elevator system in the building; and (iii) the parameters of each elevators needed to calculate its energy consumption (e.g., efficiency, inertia, roping arrangement . . . ). These also include dynamic parameters such as (i) a current position of each elevator car in the elevator shaft in millimeters; (ii) a current speed of each elevator; and (iii) a current load inside each car.

The energy calculator will continuously calculate the energy within the system to determine how to prepare for and handle a power failure in order to allow all the occupied elevators to get to the next possible stop. Based on the data above concerning each elevator, the energy calculator calculates the energy needed by each elevator to move it to the next possible stop. If there is an energy surplus, the energy calculator determines a plan to prepare to store surplus energy within empty elevators if possible so that is can be used during a power failure.

The energy calculator has the capability to dispatch elevators during normal operation. This is to ensure that sufficient energy exists within the system should a power failure take place.

A number of scenarios that an energy calculator could encounter are shown in the following examples, which use the following assumptions: (1) they assume that the counterweight ratio is 50% (whereas in practice the energy calculator would know the actual counterweight ratio for each elevator); and (2) they assume a 100% efficient system (whereas the energy calculator has a sophisticated energy model of each elevator that allows it to calculate how much energy each elevator will consume or regenerate during a certain journey at a certain load and speed). It is important to stress that these scenarios are only possible hypothetical scenarios that could take place after the power failure, but are detected before the power fails by the energy calculator in order to take any necessary action.

The energy calculator will provide a plan to prepare for a power outage which could include any of the following commands:

1. Move an empty elevator upwards to supply energy or downwards to store energy.
2. Slow an elevator down to conserve energy.

The energy calculator will also provide a plan to handle a power outage which would include the following commands:

1. The speed that each elevator in the elevator system should be run.
2. The destination at which each elevator should be stopped. In case of moving elevators, this would usually be the next possible stop, or even between floors if there is not sufficient energy in the system. In the case of regenerating elevators, it could be further than the next possible stop if the energy they are regenerating is needed to power other elevators in the system.
3. When considering the destination to which an elevator is heading, the energy calculator takes into consideration the destination of the moving elevators compared to the distance of the regenerating elevator. For example, if the distance to destination of the moving elevator is more than the distance to destination of the regenerating elevator, then the destination of the regenerating elevator is extended by one stop to ensure that sufficient energy is supplied to the moving elevator.
4. In cases where it is not possible to extend the destination of the regenerating elevator by one extra stop (e.g., because the next stop is a terminal stop) the reverse energy calculator shall be used to make use of the kinetic energy in the moving elevator.

The plan to prepare and plan to handle is continuously being determined by the energy calculator and forwarded to the movement controller.

Possible Scenarios in Energy Calculation

Figure 2:
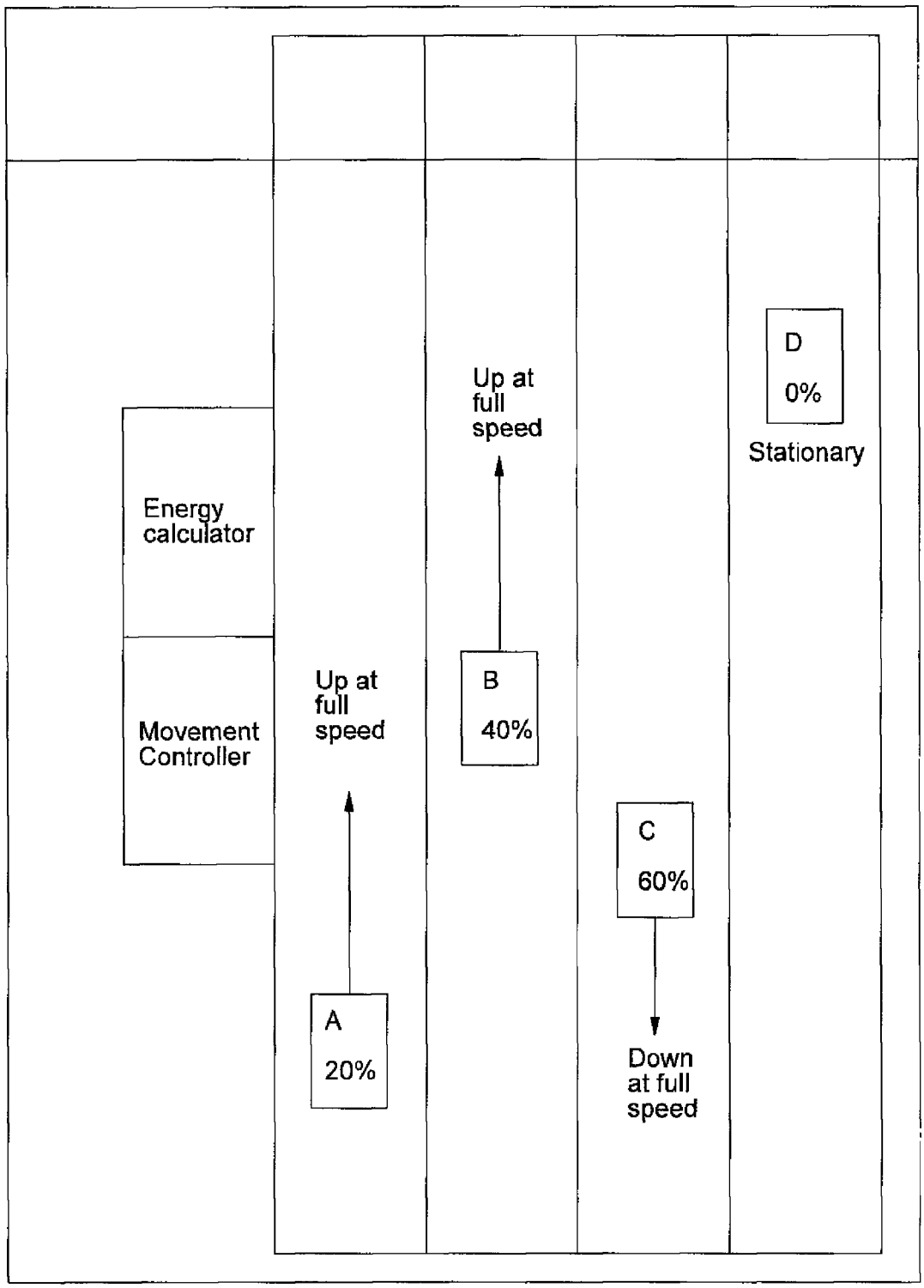
FIG. 2 is a diagram depicting an elevator system wherein three elevators are moving and one elevator is stationary. The three running elevators are providing surplus energy, and this will allow them to carry on running to the next possible stop if the power supply is interrupted.
Figure 3:
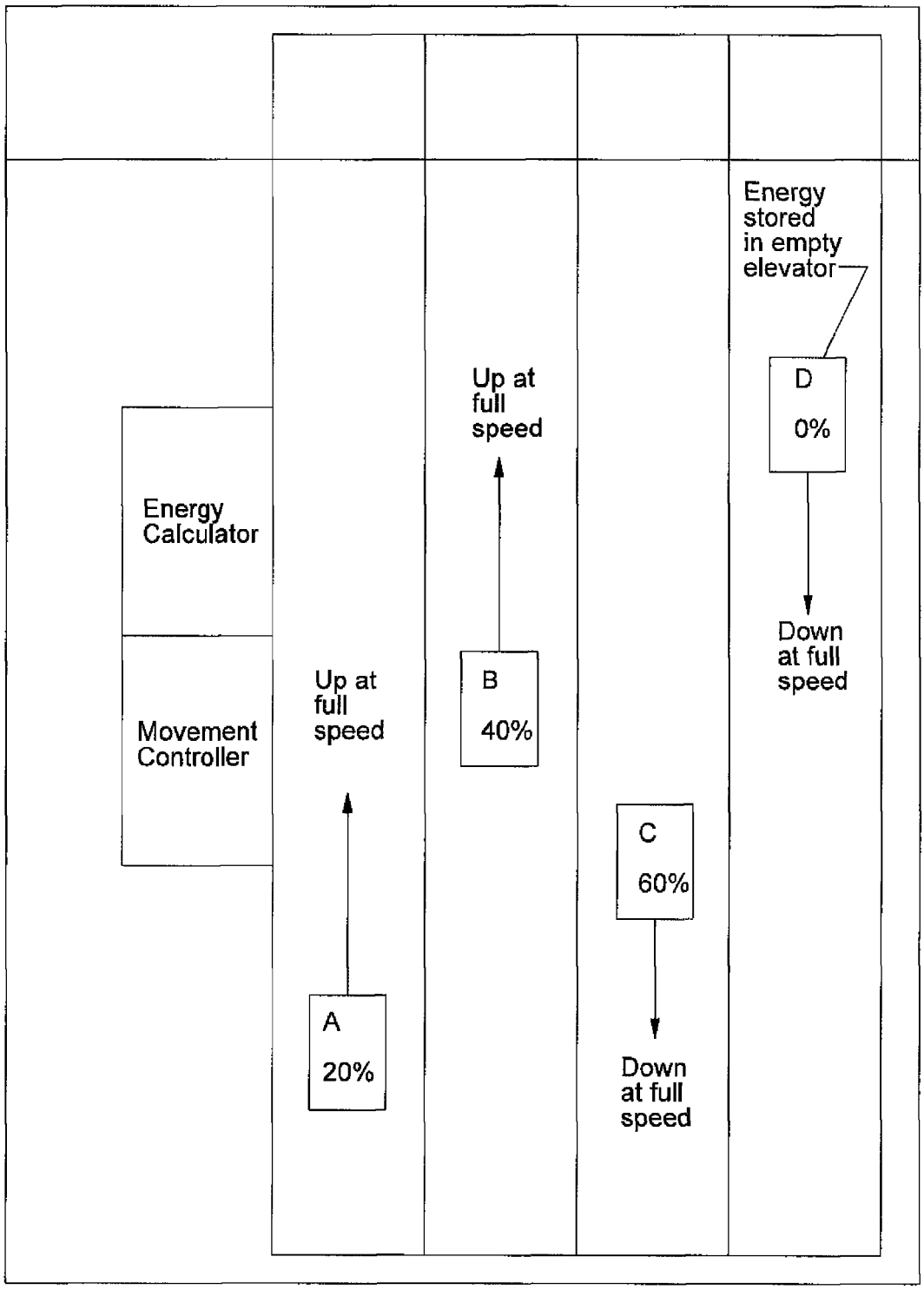
FIG. 3 is a diagram depicting an elevator system similar to FIG. 2, wherein the surplus energy from the three elevators is being stored in the fourth (empty) elevator, which is directed in the down direction at full speed.
Figure 4:
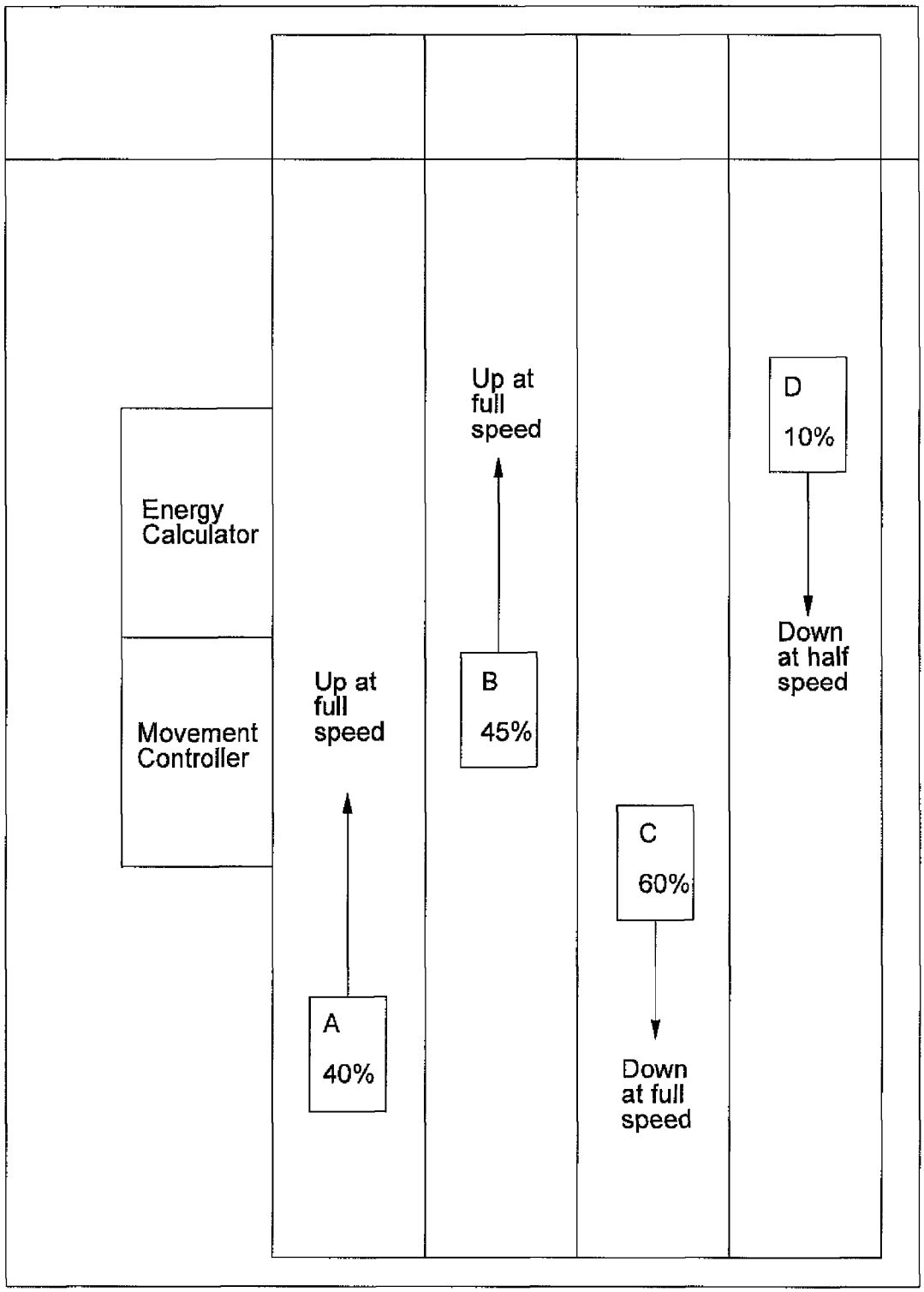
FIG. 4 is a diagram depicting an elevator system similar to FIG. 2, wherein the surplus energy from the three moving elevators is only sufficient to move the empty elevator at half speed to store the surplus energy.

The energy calculator could encounter any of the following scenarios:

Scenario I: It is possible to balance all the elevators using the available energy (i.e., sum of energy is zero or there is a surplus). An example of this situation is shown in FIG. 2. In cases where there is surplus energy, it may be possible to store some of this energy in an empty elevator by moving the elevator downwards (i.e., storing the surplus energy in the counterweight of the empty elevator). The empty elevator can be moved at full speed if there is sufficient surplus energy (FIG. 3) or at half speed if there is not sufficient energy to move it at full speed (FIG. 4).

Figure 5:
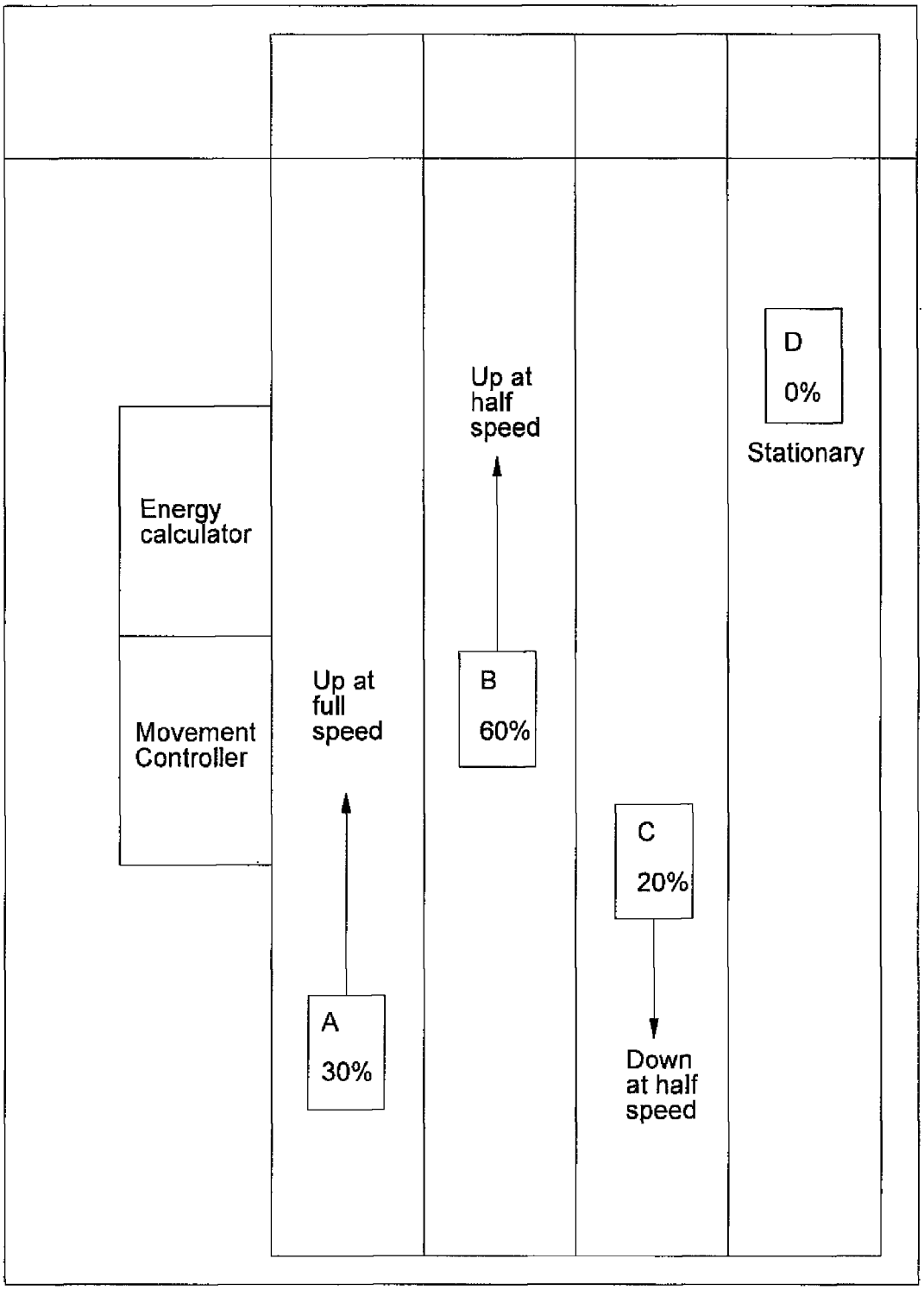
FIG. 5 is a diagram depicting an elevator system wherein the surplus energy from one elevator is only sufficient to move the other two loaded elevators at half speed.

Scenario II. It is possible to balance all the elevators using the total energy, but it is necessary to reduce the speed of moving elevators (following a power failure) so that the energy regenerated is sufficient. An example of this scenario is shown in FIG. 5.

Figure 6:
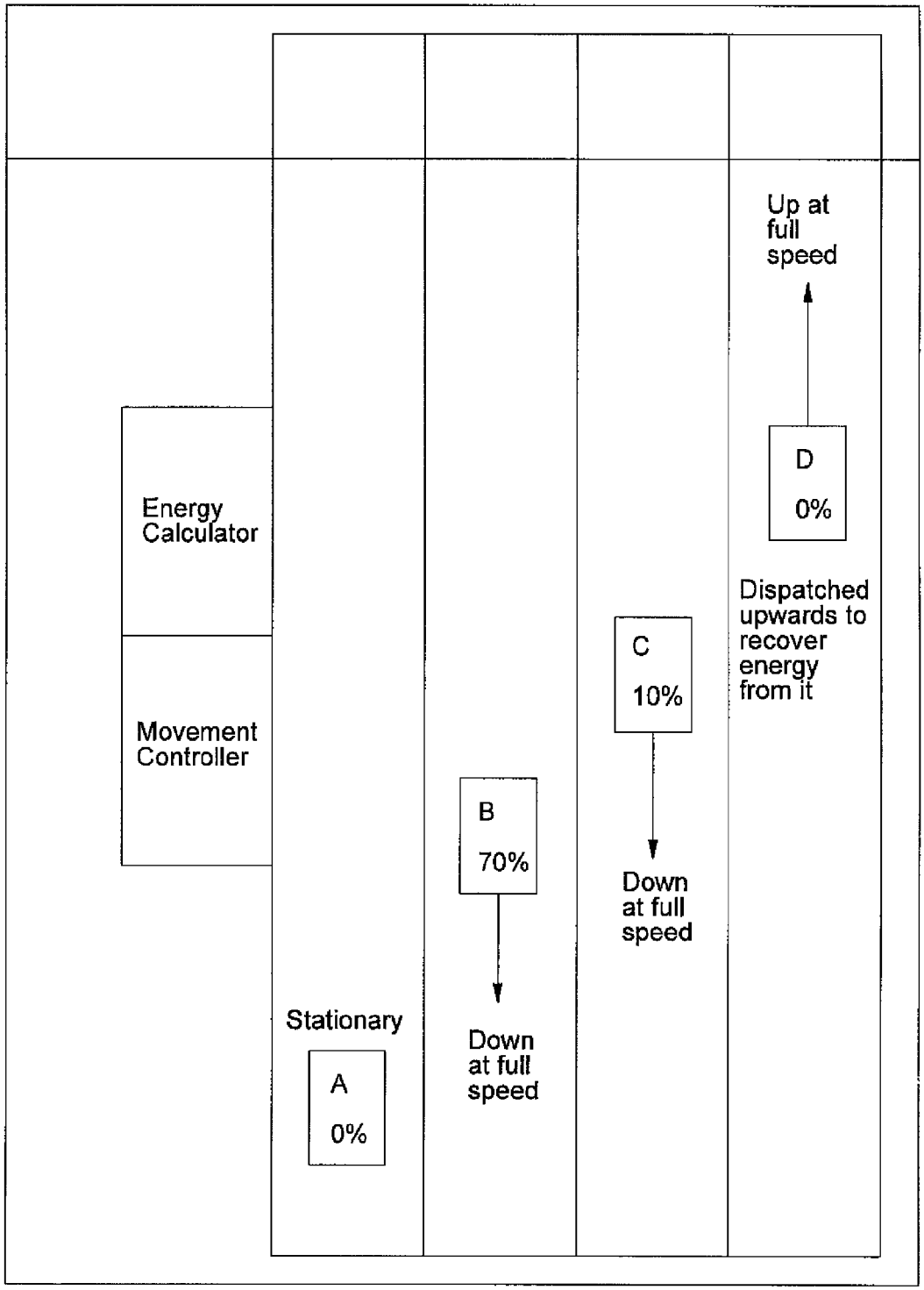
FIG. 6 is a diagram depicting an elevator system wherein there is no surplus energy in the moving elevators, and an empty elevator has to be dispatched upwards in order to provide sufficient energy for the other two elevators.

Scenario III. In this scenario it is not possible to balance all the elevators using the total energy, and it is necessary to recover some of the energy stored in an empty elevator in order to allow the other occupied elevators to carry on moving in their current direction. An empty elevator is dispatched in the up direction, such that if a power failure takes place, the empty elevator is providing sufficient energy to move the other loaded elevators to their prescribed stops (FIG. 6). In some cases, there may also be a need to reduce the speed of the moving elevators (following the power failure) so that the energy from the regenerating empty elevator suffices.

Figure 7:
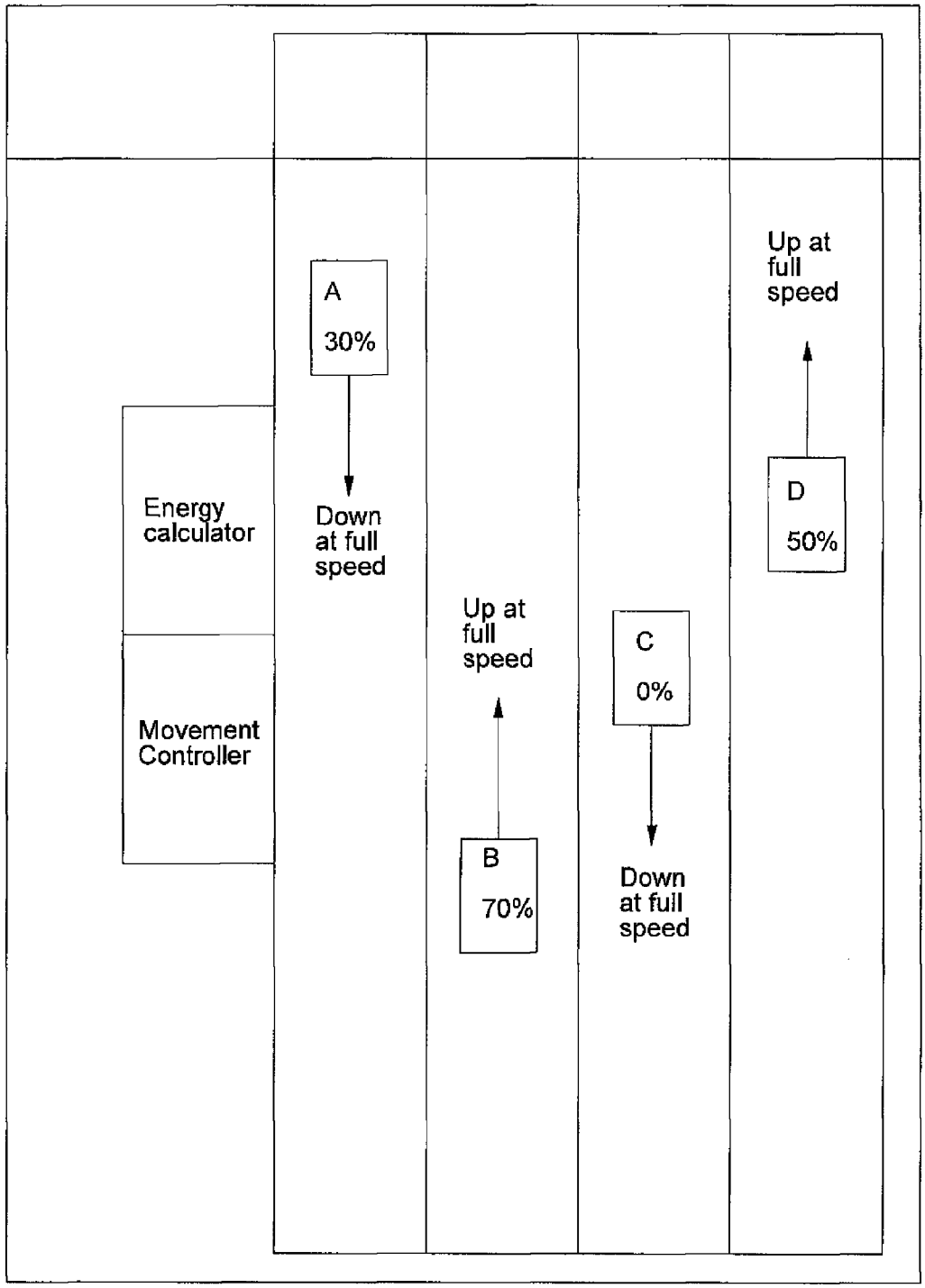
FIG. 7 is a diagram depicting an elevator system within which all the elevators are consuming energy and it is only possible to move the elevators using the energy from their kinetic energy and the energy stored in the capacitors following a power failure.
Figure 8:
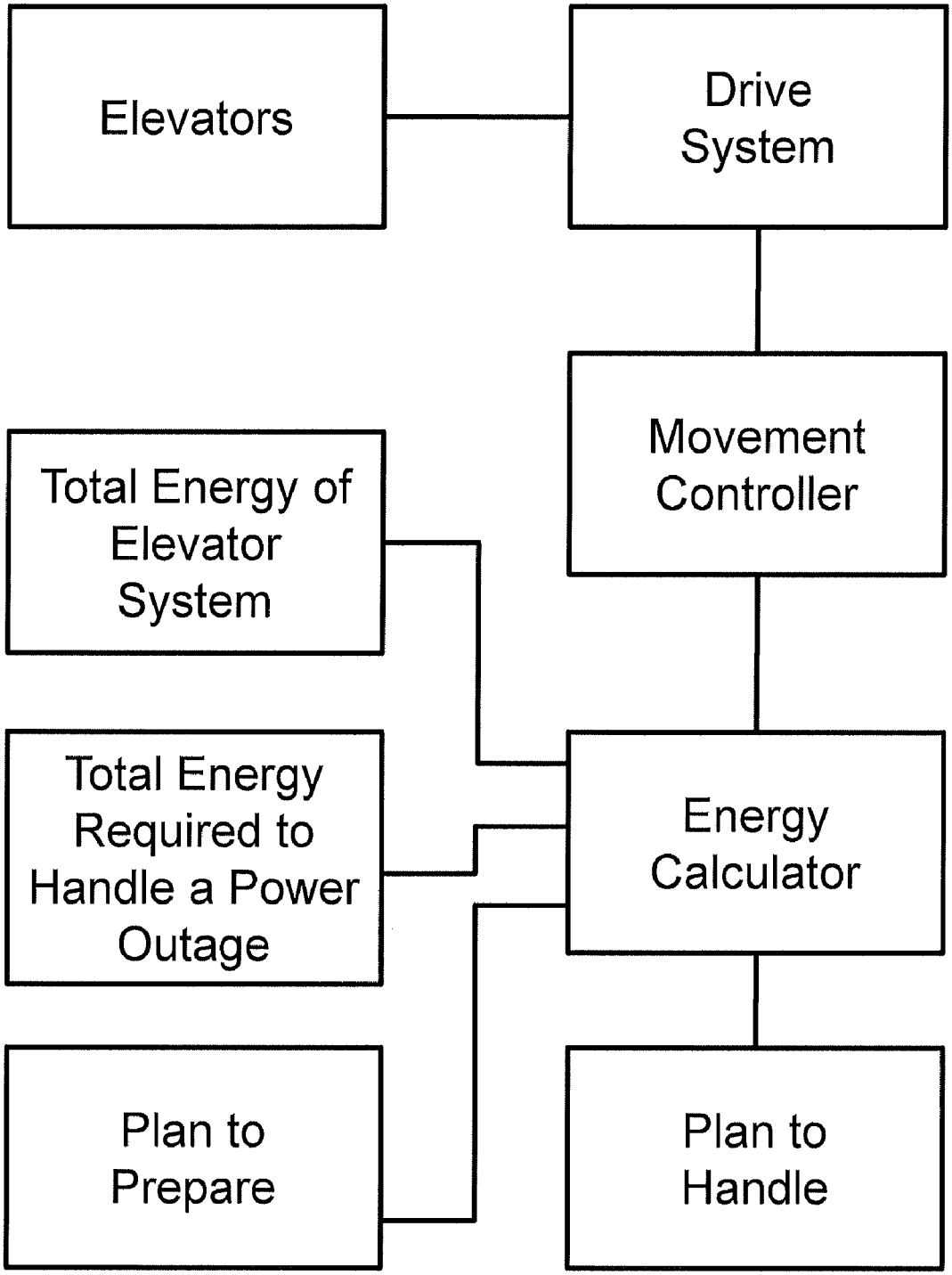
FIG. 8 is a schematic diagram of an exemplary elevator system having an energy calculator and movement controller.
Figure 9:
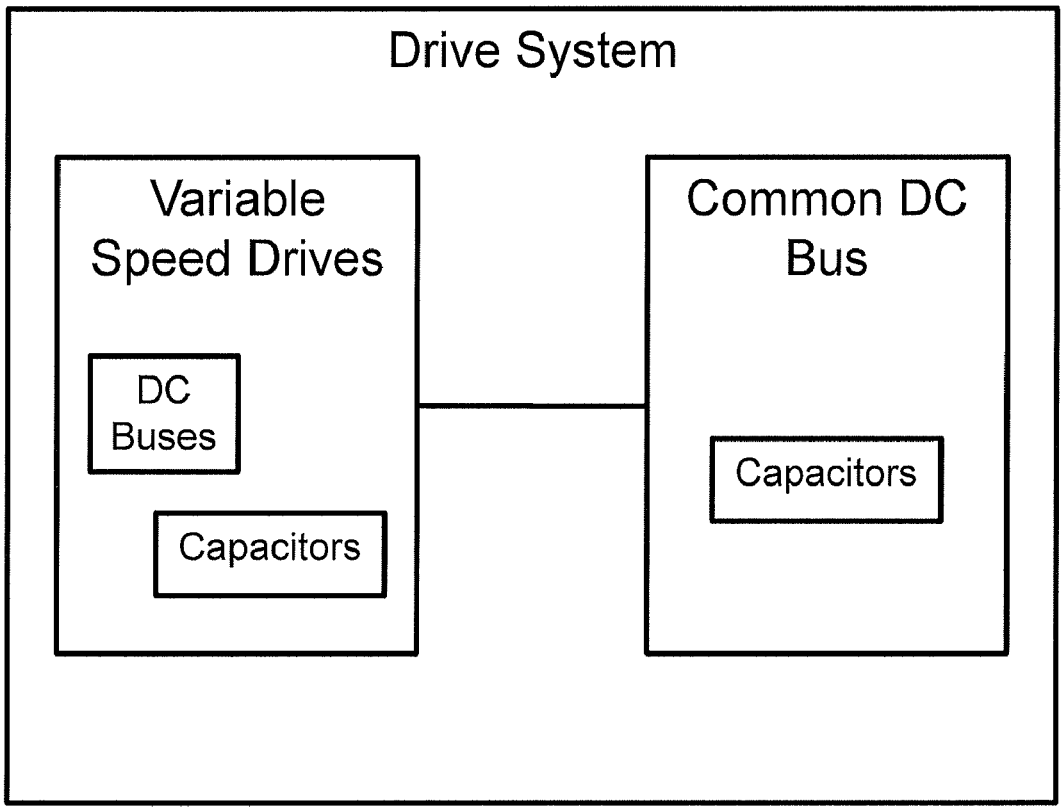
FIG. 9 is a schematic diagram of an exemplary drive system of the elevator system of FIG. 8.

Scenario IV. In this scenario, it is not possible to balance the energy between the elevators using their potential energy, and the energy has to be recovered from their kinetic energy and the energy stored in the capacitors (see FIG. 7 that shows an example of this scenario).

Movement Controller

As the energy calculator is continually determining and updating the plan to prepare and plan to handle a power outage based on the parameters of each elevator, this information is sent continuously to the movement controller.

During normal operation, the movement controller executes the plan to prepare by controlling the elevator drive system to execute commands such as dispatching an empty elevator to store or supply energy, or adjusting speed of an elevator to conserve energy. If the voltage on the bus increases above the nominal ideal value, this signifies that more energy is being regenerated than is being used by the system. The movement controller then takes action in the form of slightly reducing the speed of the regenerating elevator(s) or slightly increasing the speed of the moving elevator(s).

If the voltage on the DC bus reduces below the nominal ideal value, this signifies that more energy is being consumed than regenerated. If this occurs, the movement controller will either increase the speed of regenerating elevator(s) or reduce the speed of moving elevator(s) to balance the total energy in the system. In a preferred embodiment, the movement controller will adjust the speed of empty elevators before adjusting the speed of occupied elevators.

If there is a power outage, the movement controller executes the plan to handle a power outage by controlling the elevator drive system to adjust the speed of all the moving elevators to speed prescribed by the plan to handle, and stopping the elevators at their prescribed stops. The movement controller continuously monitors the value of the voltage on the DC bus and adjusts the real time speed of each elevator as needed.

Kinetic Energy and the Reverse Energy Calculator

When an elevator is moving at its rated speed, it possesses a certain amount of kinetic energy that is dependent on its mass and speed. If the elevator is moving against gravity (i.e. in a direction opposite the net load torque, such as when an empty car is running down), it is consuming energy from the power supply and increasing its potential energy. In the event of a power failure, in order for an elevator that is moving against gravity to continue moving to its prescribed stop, it must be supplied with energy in an amount equivalent to the difference between the potential energy it would have at its prescribed stop and the potential energy it possesses at its present location (as well as any losses due to friction, etc). Some of the requisite potential energy could be supplied by the kinetic energy associated with the moving elevator that will be recovered when the elevator stops.

The reverse energy calculator is used in cases where the only possible source of energy for a moving elevator is the kinetic energy stored within its moving masses. The reverse energy calculator assesses the energy within the moving elevator and calculates the most suitable stopping speed profile.

The distance that can be traveled against gravity using kinetic energy can be estimated based on the parameters of the elevator. For example, the kinetic energy that can be recovered from an elevator having a car with a mass of 1500 kg, moving at 2 m/s, and having a counterweight balance of 50%, could be calculated based on the load in the car. If the rated load were 1000 kg, the counterweight balanced at 50% would have a mass of 2000 kg. The kinetic energy stored within the three masses (the passengers, the car and the counterweight) and ignoring the kinetic energy in other masses and in rotational inertias, is calculated as follows:

$$KE = \frac{1}{2} \times m \times v^2 = \frac{1}{2} \times (1000 + 1500 + 2000) \times 2^2 = 9000J$$

Using this value, the distance that the out of balance mass can be moved against gravity can be determined:

$$\Delta PE = m \times g \times h = 500 \times 9.81 \times h = 9000J$$

$$h = 1.835\text{m}$$

This calculation assumes perfect efficiency, whereas in reality, some energy would be lost to friction, etc. The distance that could be traveled using kinetic energy in this case is relatively short, but in certain cases and depending on the position of the elevator from the next stop, it might be sufficient.

The distance that an elevator traveling against gravity could travel using kinetic energy is a function of the balance condition of the moving elevator (i.e., how balanced the load in the car is against the counterweight). For example, if the load in the above calculations had been 450 kg instead of 1000 kg, the calculation of kinetic energy would be as follows:

$$KE = \frac{1}{2} \times m \times v^2 = \frac{1}{2} \times (450 + 1500 + 2000) \times 2^2 = 7900J$$

The distance that the elevator could be moved against gravity in this case is as follows:

$$\Delta PE = m \times g \times h = 500 \times 9.81 \times h = 7900J$$

$$h = 16.1\text{m}$$

In the above example, where the car and its load are only 50 kg lighter than the counterweight (as opposed to 500 kg heavier in the first example), the elevator can move much further using kinetic energy. Thus, if the elevator is nearer to the balanced condition, the kinetic energy stored is more likely to be sufficient to move the car to its prescribed stop without requiring surplus energy from other elevators in the elevator system.

Energy Storage Capacitors

The capacitors in the DC bus are generally not sufficiently large to store enough energy to move an out of balance elevator through a significant distance against gravity, but they can be very useful in overcoming transients and accounting for inaccuracies in the energy calculator. The energy calculator predicts the energy to a good level of accuracy, but the actual energy consumed or regenerated by the various elevators in the system will vary depending on a number of factors that are outside its control. These could include for example the accuracy of the load weighing device or the current level of maintenance of the elevator (affecting the efficiency).

To illustrate how the capacitors can overcome some transients and provide short term energy, the following example is given. Assuming a bank of 10 capacitors sized at 1 micro-F each, rated at 1000 V with a bus voltage of around 600 V DC, the energy stored in them is determined as follows:

$$E = \frac{1}{2} \times C \times V^2 = 0.5 \times 0.001 \times 10 \times 600^2 = 1800J$$

Assuming the elevator needs to overcome some energy shortage to move an out of balance mass 150 kg (i.e., a load of 350 kg in the case of the 1000 kg elevator discussed earlier), this energy would be enough to move them by the following distance:

$$\Delta PE = m \times g \times h = 150 \times 9.81 \times h = 1800J$$

$$h = 1.223\text{m}$$

Consequently, this load could be moved 1.223 m, which is useful in overcoming very short term energy transients due to imperfections in the system or the calculations.

Electric Traction Elevator Energy Calculator

The energy calculator will now be described. The calculator is a mathematical model that can calculate the energy that the elevator is consuming or will consume for a certain journey. The internal mathematical model has the relevant parameters of the elevator stored within it.

The calculator is a time-slice based calculator, and produces an internal model of the journey speed profile. For every time-slice, it calculates the change in energy between the beginning and the end of that time-slice. The net change in energy for that time-slice is added to the running total energy consumed for that journey. In one embodiment, 100 ms is used as the basis for the time-slice. At the end of each time-slice, the total change in energy for that journey is added to a running total journey energy accumulator.

The change in energy during a time-slice could either be positive or negative. A positive change indicates an increase in the energy content of the elevator system, including any dissipated energy in the form of heat or noise. A negative energy change indicates that the elevator system is returning some of its energy back to the main electrical supply. Only if the elevator drive is regenerative can the energy be ever negative.

Definition of Variables

Each variable used in the model is defined in Table 1 below. The symbol is shown in the first column, the definition in the second column, and the unit is shown in the third column.

The efficiency of the whole elevator installation is combined into one variable, $\eta$. This variable includes the efficiency of the gearbox (if geared), the motor, the drive, and any pulleys in the system.

In general, lower case symbols are used for variables and upper case symbols are used for constants.

TABLE 1

| Symbol | Description | Unit |
|---|---|---|
| $\omega(t)$ | Rotational speed of the motor at time t | radians/second |
| $\Delta d(t)$ | Distance travelled by elevator during one time-slice commencing at time t (positive for up, negative for down) | metres |
| $\Delta KE(t)$ | Change in kinetic energy during one time-slice commencing at time t | Joules |
| $\eta f100$ | Forward system efficiency at full load [%] | dimensionless [%] |
| $\eta f25$ | Forward system efficiency at 25% load [%] | dimensionless [%] |
| $\eta f00$ | Forward system efficiency at 0% load [%] | dimensionless [%] |
| $\eta r100$ | Reverse system efficiency at full load [%] | dimensionless [%] |
| $\eta r25$ | Reverse system efficiency at 25% load [%] | dimensionless [%] |
| $\eta r00$ | Reverse system efficiency at 0% load [%] | dimensionless [%] |
| $\Delta PE(t)$ | Change in potential energy of out of balance masses during on time slice commencing at time t | Joules |
| $F_S$ | Force needed to move the car in the shaft at constant speed | Newtons |
| $g = 9.81$ | Acceleration due to gravity | metres/second$^2$ |
| I | Total moment of inertia (reflected at the motor shaft) | kilogram metre$^2$ |
| $M_C$ | Mass of car | kilograms |
| $M_{rated}$ | Rated load of car | kilograms |
| $\alpha$ | Counterweight Ratio | dimensionless [%] |
| $m_{OB}(t)$ | Out of balance masses | kilograms |
| $m_P$ | Actual mass of the passenger load in the car during a journey | kilograms |
| $M_{rope}$ | Mass of the ropes per unit length | kilograms/metre |
| $m_T$ | Total translational masses | kilograms |
| $v(t)$ | Velocity of the translational masses at time t | metres/second |
| $g_r$ | Gearbox reduction ratio | dimensionless [:1] |
| $r_r$ | Roping ratio: This represents the ratio of the rope speed to the car speed (e.g., 4:1, 2:1 or 1:1) | dimensionless [:1] |
| $d_S$ | Traction sheave diameter: The traction sheave is the grooved pulley that moves the main suspension ropes. | metres |
| $t_S$ | Time slice duration (in this case 100 milli-seconds) | seconds |
| v | Rated velocity | metres/second |
| a | Rated acceleration | metres/second$^2$ |
| j | Rated jerk | metres/second$^3$ |
| $d_{trip}$ | Trip distance | metres |
| $t_v$ | Time to reach maximum speed (or time to reach the highest possible speed if full speed is not reached). | seconds |
| JT | Journey time for the trip: Calculated duration of the journey in seconds. | seconds |
| $RL_{final}$ | Rope length from top of car parked on highest floor, to top of sheave | metres |
| $Pos_{start}$ | Starting position for car (metres above reference) | metres |
| $Pos_{car(t)}$ | Current position of car (metres above reference) | metres |
| $Pos_l$ | Floor position of lowest floor (metres above reference) | metres |
| $Pos_h$ | Floor position of highest floor (metres above reference) | metres |
| $RL_{car(t)}$ | Current rope length from top of car to top of sheave | metres |
| $RL_{CW(t)}$ | Current rope length from top of counterweight to top of sheave | metres |
| $CW_{height}$ | Height of counterweight | metres |
| $Car_{height}$ | Height of car | metres |
| $M_{comp}$ | Mass of compensation ropes (zero if no compensation) | kilograms/metre |
| $CL_{final}$ | Rope length from bottom of car parked on lowest floor, to bottom of sheave | metres |
| $P_{SS}$ | Steady state load (kW): This is the power drawn by the elevator when it is stationary. | Kilo-Watts |

Model Equations

The following sections outline the models used in the equations.

Mass of Counterweight

The mass of the counterweight is set as the sum of the mass of the car plus the rated load multiplied by the counterweight ratio.

$$M_{CW}=M_C+(\alpha\times M_{rated}) \quad (1)$$

Kinematics

Using the standard kinematics equations of motion, the duration of the journey JT can be calculated, For the duration of the trip, time t will go from zero to (JT−ts) in increments of the defined time slice. This is defined as follows:

$$t=0,t_S(JT-t_S)$$

Rope Length

The car is assigned a default start position, $Pos_{start}$.

$$Pos_{car}(t)=Pos_{start}+d(t)$$

The length of the car rope is calculated using the following equation, as dependent on the car position and the roping ratio:

$$RL_{car}(t)=(Pos_h+RL_{final}-Pos_{car}(t))\cdot r_r$$

The length of the counterweight rope is calculated as follows, as dependent on the car position and the roping ratio:

$$RL_{CW}(t)=(Pos_{car}(t)-Pos_1+RL_{final})\cdot r_r$$

A similar approach can be used for the compensation ropes on the car and counterweight sides:

$$CL_{car}(t)=(Pos_h-Pos_1+RL_{final}+CL_{final}-Car_{height})-RL_{car}(t)$$

$$CL_{CW}(t)=(Pos_h-Pos_1+RL_{final}+CL_{final}-CW_{height})-RL_{CW}(t)$$

The following check on the rope length can be carried out. Although the rope lengths on the car and counterweight sides will vary with time, the total rope lengths will always be constant:

$$Rope_{total}(t)=RL_{car}(t)+RL_{CW}(t)$$

$$Comp_{total}(t)=CL_{car}(t)+CL_{CW}(t)$$

Out of Balance Masses

The out of balance masses are calculated as follows. The right hand side of the equation below is made up of three parts separated by addition signs. The first part of the right hand side of the equation determines the out of balance masses between the car, counterweight and passengers. The second part of the right hand side of the equation determines the out of balance masses in the suspension ropes, and the third part of the right hand side of the equation identifies the imbalance in the compensation ropes.

$$m_{OB}(t)=(M_C+m_p-M_{CW})+(RL_{car}(t)-RL_{CW}(t))\cdot M_{rope}+(CL_{car}(t)-CL_{CW}(t))\cdot M_{comp}$$

Translational Masses

The sum of the translational masses (i.e., not rotational) is the sum of the mass of the car, the counterweight and the passengers in the car:

$$m_{Trans}=M_C+M_{CW}+m_P$$

The mass of the suspension ropes is calculated as follows:

$$m_{SRopes}=[(Pos_h-Pos_1)+2\cdot RL_{final}]\cdot M_{rope}$$

The mass of the compensation ropes is calculated as follows:

$$m_{CRopes}=[(Pos_h-Pos_1)+2\cdot CL_{final}]\cdot M_{comp}$$

Rotational Speed

The motor shaft rotational speed is related to the linear car speed as follows as a function of the sheave diameter, gearing ratio, and roping ratio:

$$\omega(t)=\frac{v(t)\cdot 2\cdot g_r\cdot r_r}{d_s}$$

Kinetic Energy

The four elements of the kinetic energy are determined using the $$\frac{1}{2}mv^2$$

format for translational or $$\frac{1}{2}1\omega^2$$

format for rotational (the four elements are the translational masses, rotational masses, suspension ropes and compensation ropes):

$$\Delta KE(t)=\begin{bmatrix}\frac{1}{2}\cdot m_{Trans}\cdot\\(v^2(t+t_S)-v^2(t))\end{bmatrix}+\left[\frac{1}{2}\cdot I\cdot(\omega^2(t+t_S)-\omega^2(t))\right]+\left[\frac{1}{2}\cdot\frac{m_{SRopes}}{r_r}\cdot[(r_r\cdot v(t+t_S))^2-(r_r\cdot v(t))^2]\right]+\left[\frac{1}{2}\cdot m_{CRopes}\cdot[v^2(t+t_S)-v^2(t)]\right]$$

Potential Energy

In order to calculate the potential energy change during one time-slice, it is necessary to find the distance traveled in one time-slice:

$$\Delta x(t)=d(t+t_S)-d(t)$$

This value is to calculate the change in the potential energy in the out-of-balance masses (result could be positive or negative):

$$\Delta PE(t)=\Delta x(t)\cdot m_{OB}(t)\cdot g$$

It is assumed that the motor is sized based on the maximum potential energy requirements (i.e., maximum out of balance mass moving at maximum speed against gravity):

$$\Delta x_{max}=t_S\cdot RatedVelocity$$

$$m_{OBmax}=\max[|M_{CW}-M_C|\cdot|(M_C+M_{rated})-M_{CW}|]$$

$$\Delta PE_{max}=\Delta x_{max}\cdot m_{OBmax}\cdot g$$

The maximum change in potential energy represents the maximum power demand on the motor.

Shaft Frictional Losses

The shaft frictional forces are caused by the friction between the car guidance and the guide rails. For the direction of travel, only the magnitude is utilized (i.e., ignoring the sign) because the frictional losses will be positive regardless of the direction of travel.

$$\Delta SE(t)=|\Delta x(t)|\cdot F_S$$

It will not be expected of the user to enter the value for Fs; this will be derived during on-site tests and will be estimated for each site depending on the size of the installation, optionally including the type of guide shoes, i.e., sliding or rollers.

The total energy in the shaft is the summation of the shaft frictional load losses and the change in potential energy:

$$\Delta E_{shaft}(t)=\Delta PE(t)+\Delta SE(t)$$

Hypothetical Energy Change

The hypothetical total change in energy in the system during the time-slice can then be calculated, as follows:

$$\Delta E_h(t)=\Delta KE(t)+\Delta E_{shaft}(t)$$

This is called hypothetical change because it takes neither the efficiencies of the system nor the direction of flow of energy into account.

Motor Loading

It is necessary to find the motor loading as this is important for the calculation of the load dependent efficiency values.

The motor loading is the ratio of the current hypothetical change of energy to the maximum possible potential energy change.

$$\text{Load}(t) = \frac{|\Delta E_h(t)|}{\Delta PE_{max}}$$

Forward System Efficiency

The system efficiency is load dependent and direction dependent.

Depending on the current loading of the motor, the value of the forward efficiency can be calculated as shown below. The load can vary in increments of 0.01 up to a maximum value of 2.

$$\text{Ld}=0,0.01 \ldots 2$$

An if/else/then statement can be used to find the value of the load dependent efficiency. The efficiency function is defined as a piecewise linear curve with three points at 0%, 25% and 100% load with straight lines connecting them.

$$\eta_f(Ld) = \text{if}\left[\begin{array}{l} Ld < 0.25,\ \eta_{f00} + \dfrac{[Ld(\eta_{f25} - \eta_{f00})]}{0.25}, \\ \eta_{f25} + \dfrac{(Ld - 0.25)}{0.75} \cdot (\eta_{f100} - \eta_{f25}) \end{array}\right]$$

The calculated value is then checked against logical limits, as below. It should not be allowed to drop below the minimum value, $$\eta_f(Ld)=\max(\eta_{f00},\eta_f(Ld)),$$

or go above the maximum value:

$$\eta_f(Ld)=if(Ld>1,\eta_{f100},\eta_f(Ld))$$

Reverse System Efficiency

The system efficiency is load dependent and direction dependent. Depending on the current loading of the motor, the value of the forward efficiency can be calculated as shown below. The load can vary in increments of 0.01 up to a maximum value of 2.

$$\text{Ld}=0,0.01 \ldots 2$$

An if/else/then statement is used to find the value of the load dependent efficiency. The efficiency function is defined as a piecewise linear curve with three points at 0%, 25% and 100% load with straight lines connecting them.

$$\eta_r(Ld) = \text{if}\left[\begin{array}{l} Ld < 0.25,\ \eta_{r00} + \dfrac{[Ld(\eta_{r25} - \eta_{r00})]}{0.25}, \\ \eta_{r25} + \dfrac{(Ld - 0.25)}{0.75} \cdot (\eta_{r100} - \eta_{r25}) \end{array}\right]$$

The calculated value is then checked against logical limits, as shown below. It should not be allowed to drop below the minimum value, $$\eta_r(Ld)=\max(\eta_{r00},\eta_r(Ld)),$$

Or go above the maximum value:

$$\eta_r(Ld)=if(Ld>1,\eta_{r100},\eta_r(Ld))$$

Steady State Load

The steady state load is the power the elevator controller draws when the elevator is idle. The change in drawn energy caused by this steady state load is calculated as follows:

$$\Delta E_{SS}=P_{SS}\cdot 1000\cdot t_S$$

Non-Regenerative Drive

To convert from hypothetical energy to actual energy drawn by the system, the system efficiency (previously determined) is used in an if/then/else statement:

$$\Delta E(t) = \text{if}\left[\Delta E_h(t) > 0, \left(\frac{\Delta E_h(t)}{\eta_f(\text{Load}(t))} + \Delta E_{SS}\right), \Delta E_{SS}\right]$$

The change of energy in the time-slice is then added to the running total:

$$E_{total} = \sum_t \Delta E(t)$$

To find the instantaneous power drawn in kW, the change in energy during the time-slice is divided by the time-slice value and 1000:

$$P(t) = \frac{\Delta E(t)}{1000 \cdot t_S}$$

Heat Output for Non-Regenerative

Assuming all efficiency losses in gearbox and motor become heat, the following equation is used to calculate the heat emitted from the elevator drive. Heat output excludes any contribution from the shaft frictional force. All steady state losses are converted into heat.

$$\Delta H(t) = \text{if}\left[\begin{array}{l} \Delta E_h(t) > 0,\ \dfrac{(1 - \eta_f(\text{Load}(t))) \cdot (\Delta E_h(t))}{\eta_f(\text{Load}(t))} + \Delta E_{SS}, \\ |\Delta E_h(t)| + \Delta E_{SS} \end{array}\right]$$

To find the instantaneous heat power emission in kW, the model divides by the time-slice and 1000:

$$H_L(t) = \frac{\Delta H(t)}{1000 \cdot t_S}$$

Regenerative Drive

To convert from hypothetical energy to actual energy drawn by the system, the system efficiency derived previously is used in an if/then/else statement:

$$\Delta E(t) = \text{if}\left[\begin{array}{l} \Delta E_h(t) > 0, \left(\dfrac{\Delta E_h(t)}{\eta_f(\text{Load}(t))} + \Delta E_{SS}\right), \\ (\Delta E_h(t) \cdot (\eta_r(\text{Load}(t))) + \Delta E_{SS}) \end{array}\right]$$

The change of energy in the time-slice is then added to the running total:

$$E_{total} = \sum_t \Delta E(t)$$

To find the instantaneous power drawn in kW, the change in energy during the time-slice is divided by the time-slice value and 1000:

$$P(t) = \frac{\Delta E(t)}{1000 \cdot t_S}$$

To find the total energy consumption for the full trip, the result in Joules is converted to kWh by dividing by 1000 J/KJ, 60 second/minute and 60 minutes/hour:

$$\text{kWh}_{trip} = \frac{E_{total}}{1000 \cdot 60 \cdot 60}$$

The level of loading is derived by dividing the mass of passengers in the car by the rated load:

$$\text{Loading} = \frac{m_p}{M_{rated}}$$

Heat Output for Regenerative

Assuming all efficiency losses in the gearbox and motor are due to heat generation, the following equation can be used to calculate the heat emitted from the elevator drive. Heat output excludes any contribution from the shaft frictional force. All steady state losses are converted into heat.

$$\Delta H(t) = \text{if}\left[\begin{array}{c} \Delta E_h(t) > 0, \ \dfrac{(1 - \eta_f(\text{Load}(t))) \cdot (\Delta E_h(t))}{\eta_f(\text{Load}(t))} + \Delta E_{SS}, \\ |\Delta E_h(t) \cdot (1 - \eta_r(\text{Load}(t)))| + \Delta E_{SS} \end{array}\right]$$

To find the instantaneous heat power emission in kW, the model divides by the time-slice and 1000:

$$H_L(t) = \frac{\Delta H(t)}{1000 \cdot t_S}$$

Numerous modifications and variations of the present invention are possible in light of the above teachings, and therefore, within the scope of the appended claims, the invention may be practiced otherwise than as particularly described.

What is claimed is:

1. An elevator system for handling a power outage in a building having a plurality of floors comprising:

at least one elevator;

an energy calculator connected to the at least one elevator and capable of determining a total energy of the elevator system, a total energy required to handle a power outage, a plan to prepare, and a plan to handle;

a movement controller connected to the at least one elevator and the energy calculator, wherein the movement controller receives the plan to prepare and the plan to handle from the energy calculator, and the movement controller executes the plan to prepare if there is no power outage and the movement controller executes the plan to handle if there is a power outage; and an elevator drive system connected to the at least one elevator and the movement controller, the movement controller controlling the elevator drive system, and wherein the elevator drive system controls the direction, speed, and stopping of the at least one elevator.

2. The elevator system of claim 1, wherein the elevator drive system performs a function selected from the group consisting of reducing the speed of the at least one elevator, stopping the at least one elevator, and impeding movement of the at least one elevator, if the movement controller executes the plan to handle.

3. The elevator system of claim 2, wherein the elevator drive system reduces the speed of the at least one elevator in response to the execution of the plan to handle by the movement controller.

4. The elevator system of claim 2, wherein the elevator drive system reduces the speed of the at least one elevator to zero in response to the execution of the plan to handle by the movement controller.

5. The elevator system of claim 4, wherein the movement of the at least one elevator, after the elevator drive system reduces the speed of the at least one elevator to zero, is impeded.

6. The elevator system of claim 2, wherein if the total energy of the elevator system is greater than the total energy required to handle a power outage, the total energy of the elevator system is used to move the at least one elevator to a next possible floor where the movement of the at least one elevator is impeded.

7. The elevator system of claim 2, wherein if the total energy of the elevator system is less than the total energy required to handle a power outage, the movement of the at least one elevator between floors is impeded.

8. An elevator system for handling a power outage in a building having a plurality of floors comprising:

at least one elevator having at least one direct current capacitor;

an energy calculator connected to the at least one elevator and capable of determining a total energy of the elevator system, a total energy required to handle a power outage, a plan to prepare, and a plan to handle; and a movement controller connected to the at least one elevator and the energy calculator, wherein the movement controller receives the plan to prepare and the plan to handle from the energy calculator, and the movement controller executes the plan to prepare if there is no power outage and the movement controller executes the plan to handle if there is a power outage;

wherein the plan to prepare is continually determined by the energy calculator based on the total energy of the elevator system, forwarded from the energy calculator to the movement controller, and executed by the movement controller.

9. The elevator system of claim 8, wherein, if the total energy of the elevator system is less than the total energy required to handle a power outage, the plan to prepare includes recovering potential energy in the elevator system by changing the speed or location of an empty elevator.

10. The elevator system of claim 8, wherein, if the total energy of the elevator system is less than the total energy required to handle a power outage, the plan to prepare includes recovering potential energy in the elevator system by changing the speed of an occupied elevator.

11. The elevator system of claim 8, wherein, if the total energy of the elevator system is greater than the total energy required to handle a power outage, the plan to prepare includes storing energy in the at least one direct current capacitor or in an empty elevator.

12. The elevator system of claim 8, wherein the at least one elevator comprises a variable speed drive and a direct current bus;

a common direct current bus connected to the direct current bus such that the variable speed drive supplies power to the direct current bus when the at least one elevator produces energy and consumes power from the direct current bus when the at least one elevator consumes energy; and the movement controller is connected to the variable speed drive and executes the plan to prepare and the plan to handle by controlling the variable speed drive according to the voltage of the direct current bus.

13. The elevator system of claim 12, wherein, if the voltage on the direct current bus increases above a nominal value such that more energy is being generated by the elevator system than is being used by the elevator system, the movement controller directs the variable speed drive to perform a function selected from the group consisting of reducing the speed of a regenerating elevator, and increasing the speed of a moving elevator.

14. The elevator system of claim 12, wherein, if the voltage on the direct current bus decreases below a nominal value such that more energy is being consumed by the elevator system than is being regenerated, the movement controller directs the variable speed drive to perform a function selected from the group consisting of increasing the speed of a regenerating elevator, and reducing the speed of a moving elevator.

15. An elevator system for handling a power outage in a building having a plurality of floors comprising:

at least one elevator;

an energy calculator connected to the at least one elevator and capable of determining a total energy of the elevator system, a total energy required to handle a power outage, a plan to prepare, and a plan to handle;

a movement controller connected to the at least one elevator and the energy calculator, wherein the movement controller receives the plan to prepare and the plan to handle from the energy calculator, and the movement controller executes the plan to prepare if there is no power outage and the movement controller executes the plan to handle if there is a power outage; and an elevator drive system connected to the at least one elevator and the movement controller, the movement controller controlling the elevator drive system, and wherein the elevator drive system controls the direction, speed, and stopping of the at least one elevator;

wherein the plan to handle is continually determined by the energy calculator and communicated to the movement controller, which executes the plan to handle by controlling the elevator drive system.

16. The elevator system of claim 15, wherein the energy calculator continually calculates the plan to handle that includes storing energy in an empty elevator by moving the empty elevator downwards.

17. The elevator system of claim 15, wherein the energy calculator continually calculates the plan to handle that includes regenerating energy by reducing the speed of an occupied elevator.

18. The elevator system of claim 15, wherein the energy calculator continually calculates the plan to handle in which the movement controller directs an empty elevator upward to recover stored energy, the recovery of which permits an occupied elevator to continue moving.

19. The elevator system of claim 15, wherein the energy calculator continually calculates the plan to handle in which energy is conserved by reducing the speed of an occupied elevator.

20. The elevator system of claim 15, wherein the at least one elevator comprises a direct current bus and at least one capacitor, and the energy calculator continually calculates a plan to handle in which energy is provided to the elevator system from a source selected from the group consisting of the kinetic energy of the at least one elevator, and the energy stored in the at least one capacitor.

* * * * *